United States Patent [19]

Wertanen

[11] 4,286,516

[45] Sep. 1, 1981

[54] ELECTRONIC CONTROL FOR TIMING HAMMERS IN IMPACT PRINTERS

[75] Inventor: Harry Wertanen, Plymouth, Mich.

[73] Assignee: Burroughs Corporation, Detroit, Mich.

[21] Appl. No.: 84,817

[22] Filed: Oct. 15, 1979

[51] Int. Cl.[3] ..... B41J 7/92

[52] U.S. Cl. ..... 101/93.03; 101/93.14; 400/303

[58] Field of Search .... 101/93.03, 93.14, 93.29–93.34; 400/303, 304, 305, 306.1–306.4, 307, 307.1, 307.2

[56] References Cited

U.S. PATENT DOCUMENTS

| | | | |
|---|---|---|---|
| 3,303,775 | 2/1967 | Gianvzzi | 101/93.14 |
| 3,759,363 | 9/1973 | Castle et al. | 400/303 X |
| 3,858,509 | 1/1975 | Grundherr | 101/93.03 X |
| 3,866,533 | 2/1975 | Gilbert et al. | 101/93.14 |
| 4,055,117 | 10/1977 | MunAux | 101/93.14 |
| 4,083,299 | 4/1978 | Norton | 101/93.03 X |
| 4,213,714 | 7/1980 | Jones et al. | 400/306 X |

FOREIGN PATENT DOCUMENTS

| | | | |
|---|---|---|---|
| 1436992 | 5/1976 | United Kingdom | 101/92.03 |

OTHER PUBLICATIONS

Barrow et al., IBM Tech. Discl. Bulletin, vol. 19, No. 8, Jan. 1977, pp. 3107–3108.

*Primary Examiner*—Edward M. Coven

*Attorney, Agent, or Firm*—Delbert P. Warner; Charles E. Quarton; Kevin R. Peterson

[57] ABSTRACT

An electronic system is disclosed for use in adjusting the spacing between columns of print produced by impact printers and the like. The system adjusts the spacing electronically by use of digital logic which varies the timing between high current pulses which, in turn, drive hammers in the impact printers. With this system, timing of the high current pulses is delayed to increase the spacing and timing is advanced to decrease the spacing.

6 Claims, 4 Drawing Figures

COLUMN ADJUST CONCEPT LOGIC FLOW.

ELECTRONIC CONTROL FOR TIMING HAMMERS IN IMPACT PRINTERS

BACKGROUND OF THE DISCLOSURE

1. Field of the Invention

The art to which this invention relates concerns impact printers of various kinds including train, chain, band and drum types. More particularly, it relates to means for electronically adjusting the spacing between columns of print produced by impact printers.

2. Description of the Prior Art

Known impact printers employ a moving character font which passes by a number of print hammers at a constant velocity which, typically, is of the order of 200 inches per second. Print hammers positioned opposite to the type font are electronically activated on a selected basis by high energy pulses to impel them momentarily in a direction which causes their faces to impinge on the type font. Ribbon and paper located between the type font and the hammer heads enables the transfer of images from the type font to the paper as the hammer heads are actuated.

Due to differences in the actual operating characteristics of the print hammers, it is necessary to provide means to adjust the hammers to enable proper column-to-column spacing on the resulting printouts while assuring that the proper energy is delivered by the hammers. Possible adjustments to provide proper inter-column spacing include changes in the power stroke to the hammer and in the spacing between the hammers and the type font.

The power stroke of each hammer is produced by a fire pulse which determines the energy level with which the hammer strikes the font. The fire pulse producing the power stroke, though having an effect on spacing between printed columns, has not been treated in the past as a means of varying the spacing between the printed columns.

Mechanical adjustments in the hammer position relative to the character font, i.e. adjustments in the spacing between the hammers and the character font have been commonly relied upon as the sole means of adjusting the column-to-column spacing once the basic manufacturers tolerances have been established. In the course of manufacturing the printer this involves making manual final adjustments in spacing between the hammers and the type font within certain tolerances. When the printers are in commercial use, adjustments to correct any errors which develop in the spacing between columns involves changing the spacing between the striker tips of individual hammers and the faces of the character fonts. In practice this requires the removal of covers on the printing machine, the release of screws holding selected hammers in place, selected movement of the hammers, retightening of the screws, and replacement of the covers. The process is tedious and may consume several hours of valuable time under adverse circumstances. Just how tedious will be better appreciated when it is realized that a mirror is necessary in many instances to enable a maintenance person to see some of the parts which must be adjusted.

Reference may be made to FIG. 1 for further details of the prior art which are believed to be useful to understanding the present invention. It will be seen that FIG. 1 illustrates a prior art hammer of a kind used in printing machines to which the invention relates.

The hammer includes a frame at 2 which supports a coil and core at 4. The coil is energized by pulses through wires 6 and 8 to drive an armature 10 which is hinged at 12. An interposer 14 is supported by flexures 16 and 18 enabling a hammer face 15 on interposer 14 to be driven against a layer of paper 17 which in turn impinges against an inked ribbon or carbon 19 and a character font to form a character on the paper. A screw assembly at 20 is used to limit the travel of the armature 10 and control the force it can apply to the interposer 14 thus assuring that a satisfactory image is produced on the paper.

Adjustment of the spacing between characters, which are printed by interaction of the hammer and character fonts, is controlled chiefly in the prior art by releasing screws at 22 and 24 and adjusting the screw at 26. When the screws at 22 and 24 are loosened, permitting their shafts to be moved up and down within elongated slots at 25 and 27, it is possible to move the hammer assembly up and down relative to the hammer support base 28. This up and down movement varies the spacing between the hammer face 15 and the paper at 17 and thus the timing of the impact causing a character to form on the paper. The position of a character on the paper will be shifted in position in a direction and by an amount determined by this adjustment.

SUMMARY OF THE INVENTION

The electronic column adjustment means provided by the present invention overcomes the difficulties of tedious mechanical adjustment in the final stages of manufacture and the need, after the printer has been placed in use, for the partial disassembly of the machine and the making of tedious and time consuming adjustments to correct errors which occur in the column spacing. Briefly, with apparatus in accordance with the present invention, the timing of the firing pulse to each hammer is controlled by retarding it or advancing it from a nominal built-in time delay, to compensate for differences in the spacing between printed columns caused by changes in the timing of the firing pulses or changes in the spacing between the striker tips of the hammers and the faces of the type font. Thereby, it is possible to adjust the spacing between columns by making variations in electrical circuitry even while the printer is running without the difficulty, aggravation and down-time involved in making mechanical adjustments.

DESCRIPTION OF A PREFERRED EMBODIMENT

Figures 2, 2A, 2B:
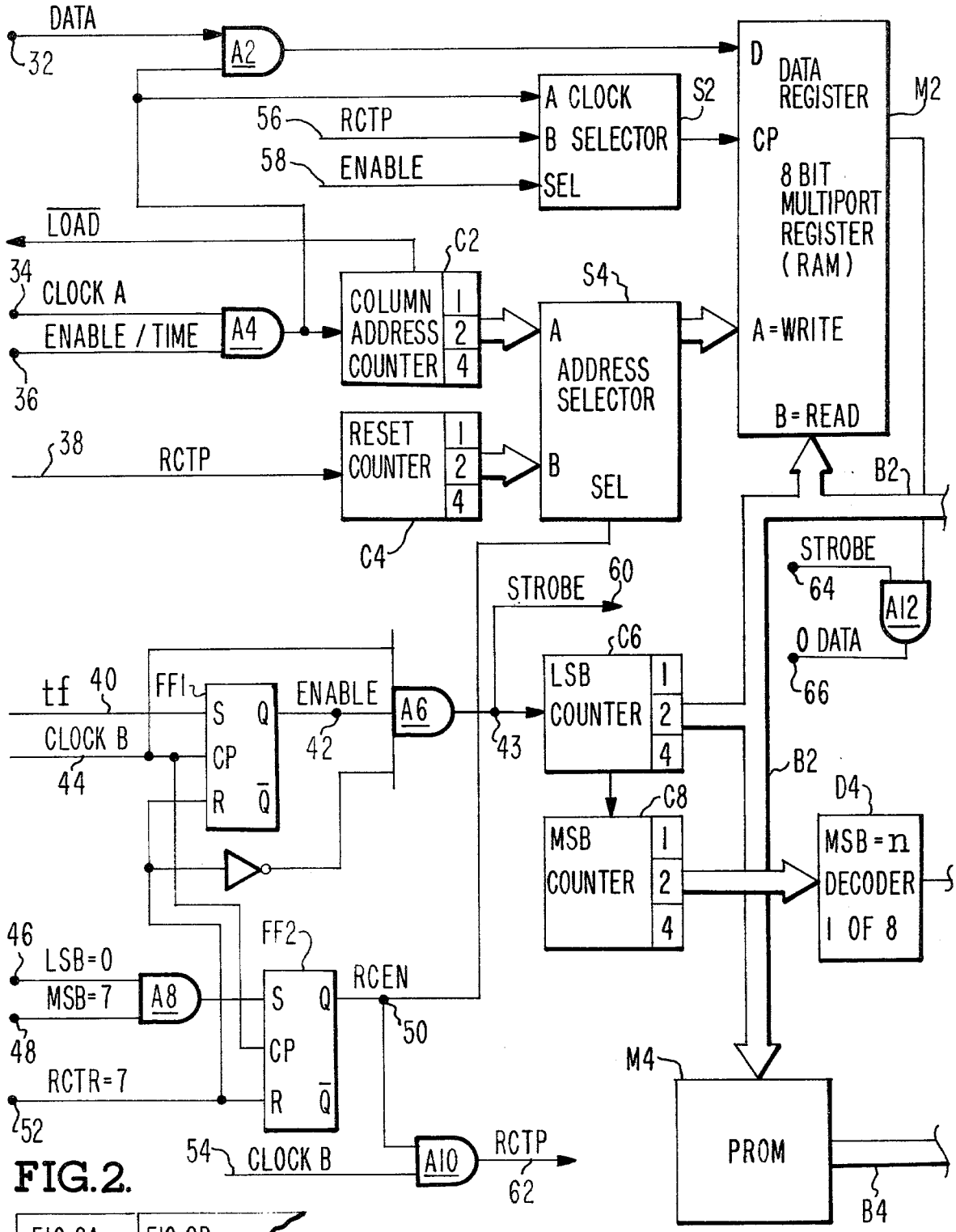
FIG. 2 is a block diagram illustrating an electronic system for electronically adjusting the spacing between printed columns in accordance with the present invention.
Figure 2B:
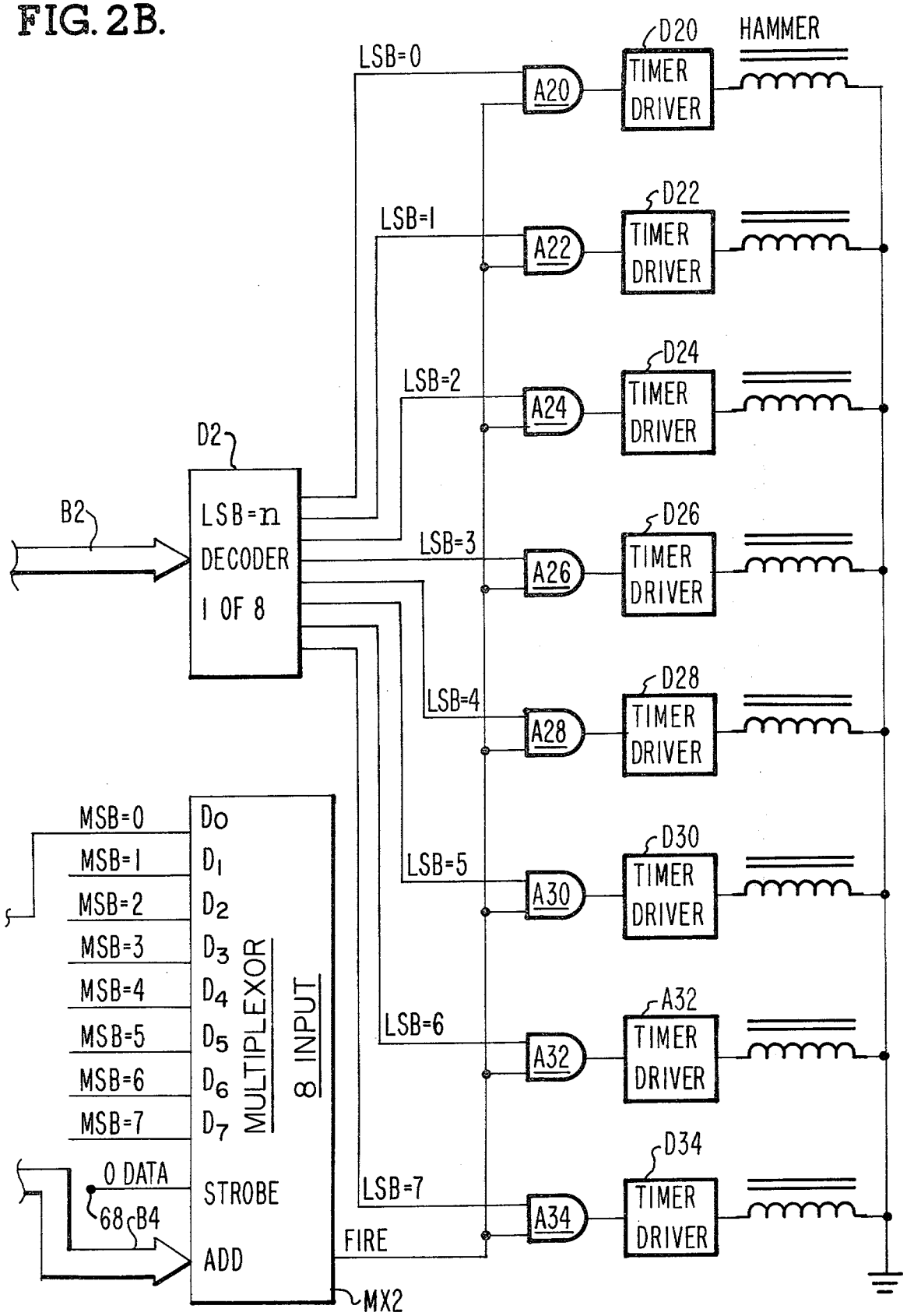
Figures 3, 3A:
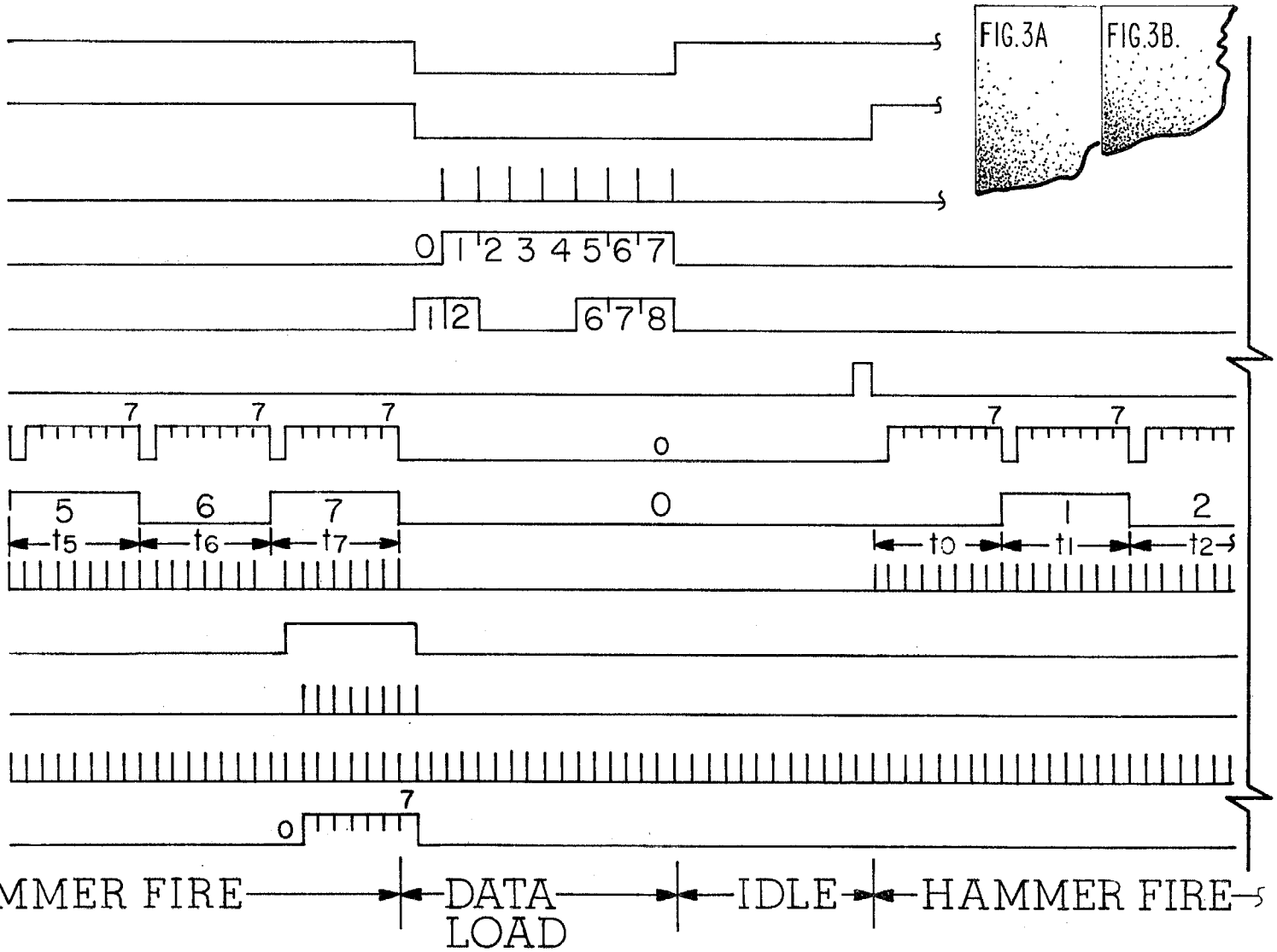
FIG. 3 is a diagram indicating relationships between various signals of use in the operation of apparatus according to FIG. 2.

Turn now to FIG. 2 for a description of a preferred embodiment of the invention. This block diagram represents equipment employed to alter the timing of the FIRE pulses used to drive hammers in a printer in a manner enabling desired adjustment of the spacing between characters printed as the hammers operate. FIG. 3 illustrates timing signals used in the implementation of the embodiment of FIG. 2.

The present invention involves two distinct phases of operation which can be designated as a data load phase and a print phase or hammer fire phase, as designated on FIG. 3, last line.

The data load phase relates to the portion of a cycle of operation during which data is stored in response to signals from the printer to the controlling device indicating that the printer is ready to accept data into a column storage register. In an exemplary impact printer, a controlling device (not shown) is synchronized to the character font sequence in such a way that the controlling device is able to locate the position of any particular character in relation to a specific print column. The data load phase occurs during a time period, designated by the controlling device, which is referred to herein also as ENABLE/TIME. During the load phase, a data register, designated M2 in FIG. 2, accepts and stores the data. In this example, the data register M2 is an eight bit random access memory, or RAM, which may embody a Fairchild Instrument register 9338. Data is entered in a serial sequence during the data load phase, being strobed in at a rate designated as the A clock rate (FIG. 3), which may be a rate typically at 250 khz on 500 khz providing pulses having periods or 4 and 2 microseconds, respectively. It will be recognized that the principles of the invention involved in the example of an eight bit register may be employed in a plurality of such registers, or in a single larger register, in association with a full scale printer without departing from the spirit of the invention.

During the print phase, corresponding to hammer fire time (last line, FIG. 3), data in the register M2 is read out of the register according to the read address from the LSB, or least significant bit, counter. The data is gated with a strobe pulse in AND gate A12 to form the signal O-Data at terminal 66 which is used as a strobe to the eight-bit input multiplexer MX2.

Turning again to consideration of the load phase and referring to FIG. 2, the load phase is started when data is applied over a terminal 32 to AND gate A2 and an ENABLE/TIME signal is applied via the input terminal 36 to an AND gate A4, while the gates A2 and A4 also receive clock pulses A. The column address counter C2 is made active during the ENABLE/TIME and advances from 0–7 at the clock rate A. The column address counter supplies the no-LOAD signal indicated on line 1, FIG. 3 to aprise the controlling device when it is available to accept data. The column address counter C2 supplies pulses to an address selector S4, which selects the appropriate write address for the data register M2. The selector S4 then addresses the write input of the data register M2 to enable the proper locations in the data register so that data from logic gate A2 may be recorded. In the process, the counter, C2 counts binary 0 through 7 to address the eight different data register locations 1 through 8, corresponding to print columns 1 through 8.

After the operations of the load phase have been completed and the data has been stored in data register M2, the print phase is started by the application of a common initiate-fire pulse $T_f$ at terminal 40 which enables the flip-flop FF1 (which may be a suitable JK flip-flop) through its set terminal S. Flip-flop FF1 provides an ENABLE signal, in the form of a pulse of relatively long duration (as indicated in FIG. 3, line 2) over the terminal 42. This ENABLE signal is applied then from terminal 42 to enable the AND gate A6. The gate A6, in cooperation with clock B pulses from terminal 44, produces strobe pulses at terminals 43 and 60. The ENABLE signal is also applied over terminal 58 of the clock selector S2 to enable clock B pulses to be applied to the CP input of the data register M2. Clock B pulses are supplied at frequencies between 250 and 500 kilohertz to have periods of 2 to 4 microseconds.

The timing, or strobe, pulses provided at terminal 43 include 64 pulses which occur during ENABLE time or hammer fire time. These strobe pulses are applied to the least significant bit counter, or LSB counter C6, which counts 0 through 7 at the clock-B rate. The top count of 7 of the LSB counter advances the most significant bit counter, or MSB counter, by one, as indicated in FIG. 3.

The strobe pulses at 43 are applied via 60 at terminal 64 of AND gate A12 during ENABLE time. The pulses are applied at clock rate B which is typically at a rate between 250 khz and 500 khz and which therefore have periods of 2–4 microseconds. These strobe pulses are gated with the output of the data register M2 to form the O-DATA signal at terminal 66 which is used to enable the eight input multiplexer via the multiplexer strobe input at terminal 68.

The LSB, or least significant bit, counter provides the read addresses over paths indicated generally by B2 to the data register M2, and to the programmable read only memory, or PROM, M4 as well as signals to be decoded by decoder D2. The decoder D2, which may be a Texas Instrument Serial Number 7442, decodes the counter counts 0–7 for addressing inputs of gates A2-0–A34 and through them the timer drivers D20–D34. The LSB counter is cycled through count 0 through 7 eight times, or once for each count of the MSB counter. The periods $t_0=t_1=t_2\ldots=t_7$ of the MSB outputs therefore have magnitudes equal to eight times those of the LSB pulses. In the case of 250 khz pulses, this period is eight times four microseconds = 32 microseconds. In the case of 500 khz pulses, this period will be eight times two microseconds = 16 microseconds.

The field alterable preprogrammed memory M4, in an exemplary case, employs an eight by three matrix to receive read addresses over any of eight paths from the LSB counter. The output of an addressed location in the memory M4 is presented over B4 as a three-input address to a multiplexer MX2. The MX2 data inputs MSB 0–7 are made active sequentially in accordance with signals through the decoder D4 (which may be a Texas Instrument Serial Number 7442) from the MSB counter, where the decoder D4 decodes each count 0–7 of the MSB counter which are used as sequential inputs to the eight data input of the multiplexer MX2, as shown in FIG. 2. When the multiplexer MX2 address inputs from B4 and the data inputs, MSBn have the same number, n = 0–7 it is possible to obtain an output in the form of a FIRE signal to the AND gates A20 through A34 if and only if there is also data on the strobe input of the multiplexor at terminal 68.

As previously indicated, changes in the timing of the FIRE pulses can be used to change the spacing between columns as they are printed. Changes in this timing depend directly on changes in time delays incorporated into the PROM which is a programmable read-only memory. Additional details of an exemplary circuit are presented below.

Figure 1:
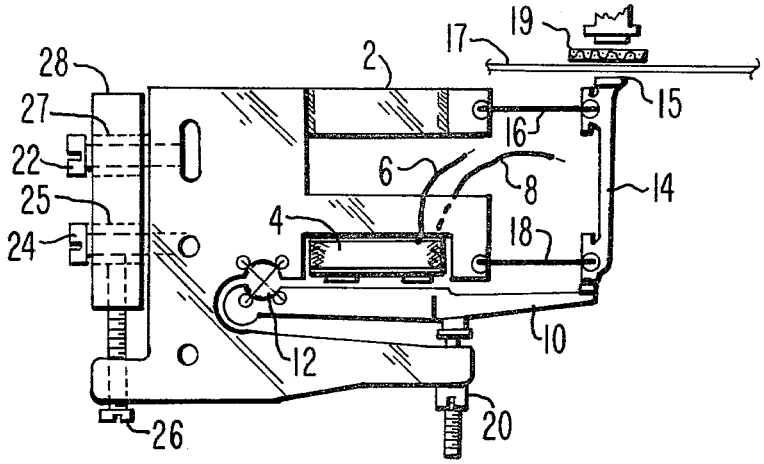
FIG. 1. PRIOR ART
FIG. 1 is a plan view in partial section of a hammer head, illustrating the manner in which the head may be attached to a printing machine and providing a basis for understanding how its position may be adjusted mechanically in accordance with the prior art to change the spacing between printed columns.
Figure 4:
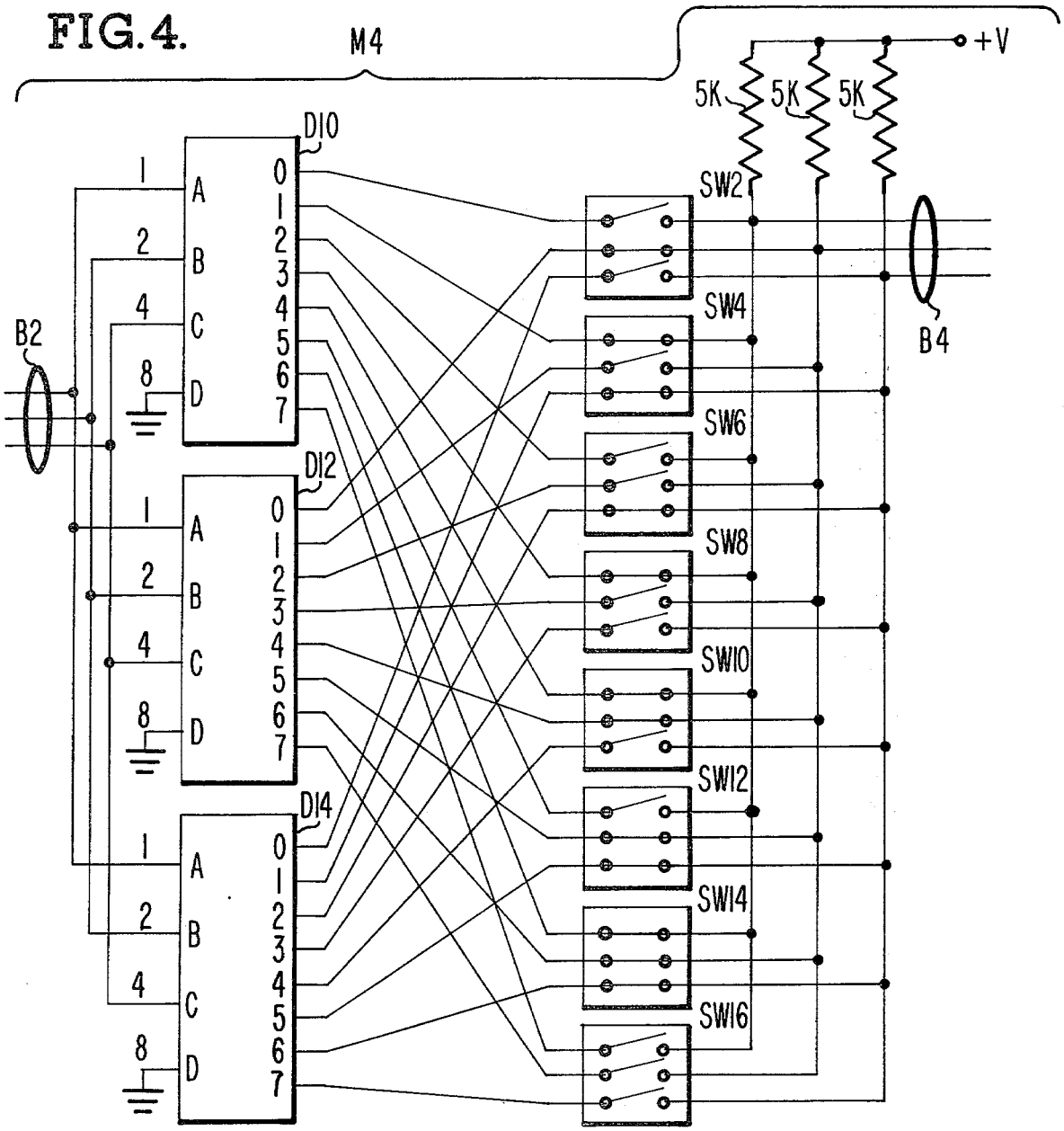
FIG. 4 is a diagram illustrating apparatus serving as an alterable PROM in accordance with FIG. 2.

An exemplary circuit for the 8×3 alterable prom M4 involves the use of a plurality of Texas Instrument BCD-to-decimal decoder/drivers Serial Number 7445, indicated in FIG. 4 at D10, D12, and D14 feeding through a plurality of switches indicated at SW2, SW4, SW6 . . . SW16 in FIG. 4.

In the circuit of FIG. 4, the outputs of the least significant bit counter are supplied over three lines designated at B2 as inputs at input terminals A, B and C of the decoder/drivers D10, D12 and D14. The terminal D of each decoder is grounded, as shown. The eight outputs of each of the decoder/drivers are applied over eight lines, as shown, as inputs to eight switches SW2, SW4 . . . SW16.

Outputs from the eight switches are applied over the twenty four paths indicated between B2 and B4 and then to the data address terminals of the multiplexer MX2.

The particular status of switches placed in the present circuit as are switches S2, S4 . . . S16 in FIG. 4 has a commanding effect on the outputs over B4, to the multiplexer MX2 and ultimately on timing of the FIRE pulses from MX2.

Normally in operating apparatus in accordance with the invention, the switches would be set so that the weight on signals passed through them would correspond to a multiplexer address of 3 or 4, which is removed from neutral by the width of 3 or 4 clock pulses. In this way the timing of the fire pulse would initially be set a point midway between the extremes made possible by apparatus according to the present invention. Adjustment could then be made simply by moving the setting of the proper switch, or switches, to effect a change in the spacing between print columns.

In the example of FIG. 4, the switches have been set so that a delay in the fire pulse of every possible length is effected, as will be clear from consideration of the following chart:

CHART A

| Least Significant Bit counter | | Multiplexer | Print |
|---|---|---|---|
| Output | Count | Address | Column |
| 1 2 4 | | | |
| 0 0 0 | 0 | 5 | 1 |
| 1 0 0 | 1 | 2 | 2 |
| 0 1 0 | 2 | 3 | 3 |
| 1 1 0 | 3 | 6 | 4 |
| 0 0 1 | 4 | 4 | 5 |
| 1 0 1 | 5 | 1 | 6 |
| 0 1 1 | 6 | 0 | 7 |
| 1 1 1 | 7 | 7 | 8 |

Figure 3B:
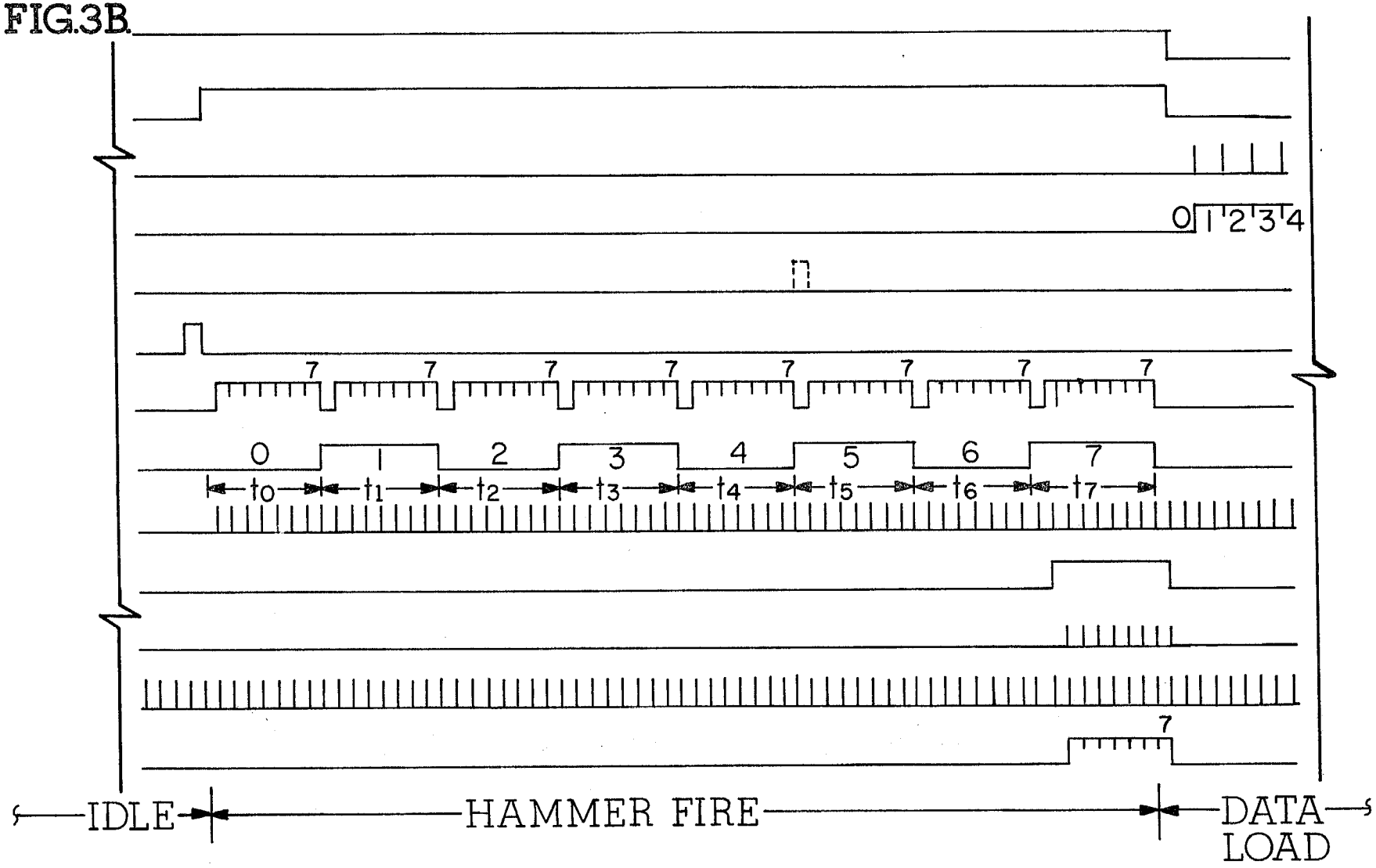

From this chart, it will be seen that outputs from the LSB counter take the form indicated under columns 1, 2 and 4 corresponding to the decimal count in the "count" column. The zero outputs in the first row of Chart A, corresponding to a zero count, are indicated in FIG. 4 as low or L outputs at terminals 0 of D10, D12 and D14. The low output from D12 is transmitted through switch SW2 to appear as L on the center line at B4. The other lines on B4 are effectively at a high level, or H. This combination of HLH will energize the multiplexer address corresponding to 5, as is indicated in the first line of Chart A under multiplexer address. (See the published data re Ser. No. 7445) With this input to the multiplexer address and data present on D5 of MX2 and data (0-DATA) indicated as present also on the STROBE terminal of MX2, then a FIRE pulse will be produced from MX2. Referring to the timing charts of FIG. 3B, it will be noted that this FIRE pulse is produced at a time when the LSB count=0, MSB=5 and data (indicated by dotted lines) is present on the DATA line.

The multiplexer, in an exemplary circuit, may be a Texas Instrument data selector/multiplexer Ser. No. 74S151. The multiplexor will receive address inputs from three lines B4 into its data select inputs. The data inputs from the MSB counter, C8, will be applied through the decoder D4, to eight inputs of the multiplexor, indicated at D0, D1 . . . D7. A strobe input, 0-data, is applied at the strobe terminal. When there is coincidence of signals on selected input terminals of multiplexor MX2 there will be a FIRE pulse at the "fire" terminal. For example, when there is coincidence of data from the most significant bit counter on any of terminals D0, D1 . . . D7 of multiplexor MX2, an 0-DATA pulse on 68 and an appropriate address input over B4 then a FIRE pulse will be delivered by MX2. From the example given in the paragraph above, data is present at D5, 0-DATA is also present at terminal 68 and the correct address of 5 is present on the address inputs terminal.

The high current timer drivers D20 through D34 are used to drive hammer solenoids which physically move the hammer armatures. The timer drivers may be formed by one shot multi-vibrators driving Darlington circuit devices. Each driver generates a fixed width drive pulse when enabled by the "and" function of LSB=n and FIRE. Each print hammer has a separate driver. The pulse width required to properly drive the hammers is dependent upon the requirements of the operating characteristics of the hammer solenoids. Typically, in train printers it is 700–800 microseconds.

When the LSB counter has been cycled through counts 0 through 7 eight times and the MSB counter has been cycled to its 7 stage, all the corrections for hammer timing will have been made for an eight hammer system. Accordingly, at that time the LSB=0 signal and MSB=7 signal will be applied over respective terminals 46 and 48 to energize AND gate A8 and set the RCEN flip-flop FF2 to provide an RCEN timing pulse as an output at terminal 50.

The RCEN pulse occurs near the end of ENABLE time and marks the time during which the data register is being cleared. The RCEN pulse is used to enable the AND gate A10 and permit clock pulses B to provide the timing for reset clock timing pulses RCTP from output terminal 62. The RCTP signals are applied over terminal 38 through the reset counter C4 and the address selector S4 to the write terminal of the data register M2 to clear old data from the register and prepare it for reception of new data. The RCTP signals are also applied to the B terminal 56 of the clock selector S2 to enable S2 to provide clock pulses to the CP terminal of the data register M2 for use in clearing the register during the RCEN portion of the ENABLE time.

The reset counter C4, in addition to its function as a source of write address inputs when the data register is being cleared, counts 0 through 7 to a top count, RCTR=7, which is applied at terminal 52 to reset FF2 and FF1, thereby clearing the ENABLE and the RCEN signals and terminating the fire control phase of operation.

Typical adjustments in character spacing which are possible with the present invention depend on certain physical values as represented by the simple equation $d=vt$ where v=character font velocity in inches per second; d=distance in inches and t=time in seconds. Given v, at a typical value of 200 inches per second and t=32 microseconds (where pulses are at 250 khz) then d=vt=6.4 thousandths of an inch. Given v at 200 inches per second and t=16 microseconds (where pulses are at 500 khz) then d=vt=3.2 thousandths of an inch.

The total adjustment range possible between print columns would range from a maximum of 22.4 thousandths of an inch at 500 khz pulse frequency to 44.8 thousandths of an inch at 250 khz pulse frequency. Assuming the neutral position to be the third pulse, the range at 250 khz would permit an adjustment from 19.2 thousandths of an inch in one direction to 25.6 thousandths of an inch in the other direction. At 500 khz the adjustment would vary from 8.6 thousandths to 12.8 thousandths of an inch.

What is claimed is:

1. In a system for electronically adjusting the spacing between columns of print on a high speed printer in which the print is produced on a moving surface by operation of an assembly of hammers, each hammer being driven by associated magnetic actuating means in response to high energy pulses:

a multiplexer responsive to selected input pulses for providing firing pulses for energizing the magnetic actuating means and driving selected print hammers;

counter means providing a first group of pulses to said multiplexer to successively enable each of a plurality of input terminals of the multiplexer;

an alterable read only memory providing a second group of pulses to said multiplexer to energize selected inputs of the multiplexer in a manner to determine when printing will occur;

a source of strobe pulses designating columns in which data is to be printed; and means for applying said strobe pulses to said multiplexer to energize a strobe input of the multiplexer;

whereby said multiplexer is energized to provide firing pulses to operate selected print hammers when pulses from said first and second groups of pulses coincide with the occurence of strobe pulses at the multiplexer.

2. The invention as claimed in claim 1, in which:

the alterable read-only memory includes a plurality of switches in series configuration between a plurality of decoder/drivers and a plurality of output terminals;

said switches making it possible by manual means to route pulses to different output terminals coupled to the selected inputs of the multiplexor and thereby to alter the timing of firing pulses.

3. In a system for electronically controlling the spacing between columns of print on a high speed printer in which the print is produced on a moving surface by operation of an assembly of hammers, each hammer being driven by associated magnetic actuating means in response to high energy pulses:

a data register coupled to receive and record data, during a data load phase, where the data represents symbols to be printed:

means receiving a common initiate-fire pulse to place the system in a print phase;

means responsive to the initiate-fire pulse to provide strobe pulses;

means responsive to said strobe pulses to provide control pulses;

said data register responding to selected control pulses to read out pulses indicating when data is present;

gating means coupled responsive to said pulses indicating when data is present and to said strobe pulses to provide data strobe pulses indicating data is present, alterable memory means coupled to respond to selected control pulses and provide timing signals on a selective basis for use in control of the timing of high energy pulses;

decoder means coupled to respond to selected control pulses to provide further control signals; and multiplexer means coupled to be responsive to coincidence of a data strobe pulse from the gating means, timing signals from the alterable memory means and further control signals from the decode means to provide a fire control pulse for use in energizing said magnetic actuating means to drive a hammer.

4. The invention as claimed in claim 3, in which:

the alterable memory means comprises a programmable read-only memory employing switches which may be changed to cause changes in the timing signals.

5. The invention as claimed in claim 3, in which:

the alterable memory means includes switch means for routing said control pulses over alternate paths to provide timing signals at different addresses of the multiplexer and thereby alter the timing of the fire control pulse.

6. The invention as claimed in claim 3, 4 or 5, in which:

the means to provide control pulses includes a least significant bit counter and a most significant bit counter;

said least significant bit counter providing control pulses in the form of address information to the data register and to the alterable memory means; and said most significant bit counter providing control pulses to the decoder means which, in turn, provides signals to the multiplexer.

* * * * *